United States Patent [19]

Ypsilantis et al.

[11] 4,323,893

[45] Apr. 6, 1982

[54] MULTI-SEGMENT ALPHANUMERIC DISPLAY FOR GREEK AND ENGLISH CHARACTERS

[76] Inventors: John Ypsilantis; Anna Ypsilantis, both of 1/124 Morts Rd., Mortdale, N.S.W. 2223., Sydney, Australia

[21] Appl. No.: 39,149

[22] Filed: May 15, 1979

[30] Foreign Application Priority Data

May 18, 1978 [AU] Australia ..... 499808

[51] Int. Cl.[3] ..... G09G 3/04

[52] U.S. Cl. ..... 340/756; 340/758; 340/765

[58] Field of Search ..... 340/766–781, 340/756–765; 315/169.1–169.4; 313/515–519, 510, 494, 483–485

[56] References Cited

U.S. PATENT DOCUMENTS 3,703,657 11/1972 Shesser ..... 340/759
3,824,582 7/1974 Glaser et al. ..... 340/759
3,855,500 12/1974 Yanagisawa ..... 340/759
3,917,972 11/1975 Yanagisawa et al. ..... 313/519
3,925,777 12/1975 Clark ..... 340/756
3,971,012 7/1976 Morokawa et al. ..... 340/756
3,991,552 11/1976 Ho et al. ..... 340/759
4,163,229 7/1979 Bodin et al. ..... 340/745

*Primary Examiner*—Marshall M. Curtis

[57] ABSTRACT

A display consisting of a fixed arrangement of eleven substantially linear display segments for displaying all letters from the Greek alphabet and English alphabet. A driver is provided for driving the eleven display segments. The display can further include at least one segment for displaying punctuation, and the driver can also drive the punctuation display segment or segments. The eleven display segments can also display any arabic number from 0–9. The display segments may be comprised of gas discharge elements, light emitting diodes, liquid crystal diodes, or the like.

10 Claims, 3 Drawing Figures

FIG. 2

| A | B |
|---|---|
| A | 6,1,2,7,3,4. |
| " | 2,7,1,6,10,8. |
| " | 7,1,6,10,8. |
| B | 2,3,8,4,11,5. |
| " | 2,3,8,7,4,11,5. |
| C | 2,3,4,5. |
| D | 3,4,9,10. |
| E | 2,3,7,4,5. |
| F | 2,3,7,4. |
| G | 2,3,4,5,6. |
| " | 2,3,4,5,11. |
| H | 3,1,7,4,6. |
| I | 2,1,6,5. |
| " | 1,6. |
| J | 1,6,5,4. |
| " | 1,6,5. |
| " | 2,1,6,5,4. |
| " | 2,1,6,5,10. |
| " | 1,6,5,10. |
| K | 8,3,7,4,11. |
| L | 3,4,5,6. |
| " | 3,4,5,6. |
| " | 3,4,5,11. |
| M | 3,9,8,4,6,1. |
| N | 3,4,9,11,1,6. |
| O | 2,3,1,4,6,5. |
| P | 3,4,2,7,1. |

| A | B |
|---|---|
| Q | 2,3,1,4,6,5,11. |
| " | 3,2,7,1,6. |
| R | 3,4,2,1,7,11. |
| " | 2,3,7,8,4,11. |
| S | 2,9,11,5. |
| T | 2,1,6. |
| U | 3,1,4,6,5. |
| V | 9,11,1,6. |
| " | 3,4,8,10. |
| W | 3,4,10,11,1,6. |
| X | 9,8,10,11. |
| Y | 3,7,1,6,5. |
| " | 9,7,1,6,5. |
| Z | 2,8,7,10,5. |
| " | 2,8,10,5. |
| . | 13. |
| , | 13,14. |
| • | 12. |

FIG. 3

| A | B |
|---|---|
| A | 6,1,2,7,3,4. |
| " | 2,7,1,6,10,8. |
| " | 7,1,6,10,8. |
| β | 2,3,8,4,11,5. |
| " | 2,3,8,7,4,11,5. |
| Γ | 4,3,2. |
| " | 4,3,2,1. |
| " | 4,3,2,8. |
| " | 9,8,10,11,5. |
| Δ | 8,10,5,6,1. |
| " | 3,4,5,9,11. |
| " | 2,9,7,4,6,5. |
| E | 2,3,7,4,5. |
| Z | 2,8,7,10,5. |
| " | 2,8,10,5. |
| H | 3,1,7,4,6. |
| Θ | 2,9,1,7,4,6,5. |
| " | 2,3,1,7,4,6,5. |
| " | 2,1,7,4,6,5. |
| " | 2,8,7,4,6,5. |
| I | 2,1,6,5. |
| " | 1,6. |
| K | 8,3,7,4,11. |
| Λ | 10,8,1,6. |
| " | 9,11,10. |
| " | 2,1,7,10,6. |

| A | B |
|---|---|
| " | 1,7,10,6. |
| " | 1,7,4,6. |
| " | 3,4,9,11. |
| " | 2,1,7,4,6. |
| M | 3,9,8,4,6,1. |
| " | 3,4,7,1. |
| N | 3,4,9,11,1,6. |
| " | 9,11,1,6. |
| " | 3,4,8,10. |
| Ξ | 2,7,5. |
| O | 2,3,1,4,6,5. |
| Π | 4,3,2,1,6. |
| P | 3,4,2,7,1. |
| Σ | 2,9,10,5. |
| T | 2,1,6. |
| Y | 9,8,10. |
| " | 3,7,1,6,5. |
| " | 9,7,1,6,5. |
| " | 3,1,4,6,5. |
| Φ | 2,3,7,1,8,10. |
| X | 9,8,10,11. |
| Ψ | 3,7,1,8,10. |
| Ω | 2,3,7,1,5. |
| " | 3,4,10,11,1,6. |
| " | 2,3,1,7,10,11. |

| | | | |
|---|---|---|---|
| , | 16,15. | ; | 21. |
| . | 17,16. | : | 12,13. |
| . . | 16,18. | ; | 12,13,14. |
| / | 19. | ? | 2,1,7,4. |
| \ | 20. | * | 7,8,9,10,11. |
| ^ | 19,20. | $ | 2,3,7,6,5,8,10. |
| ( | 8,11 | ¢ | 7,4,5,10. |
| ) | 9,10. | | |

MULTI-SEGMENT ALPHANUMERIC DISPLAY FOR GREEK AND ENGLISH CHARACTERS

BACKGROUND OF THE INVENTION

The present invention relates to certain improvements in a seven segment numeric display (such as the type used in pocket calculators) which allows it to operate as an alphanumeric display.

Existing conventional alphanumeric display units rely on a cathode ray tube (CRT) as the element which displays the letters or numerals. Thus the accompanying circuitry must provide the high voltage used to accelerate the electron beam within the CRT, and the display casing must be made to disperse the heat generated. Because technology is striving to make computers smaller, the abovementioned features of the CRT display become drawbacks, which are often quite difficult to overcome. The present invention has been designed chiefly to replace the standard CRT alphanumeric display in situations where the size and operation of the CRT display make it quite impractical.

BRIEF DESCRIPTION OF THE DRAWINGS

FIG. 2 is a table showing the combinations necessary to display the letters of the English alphabet and some punctuation symbols, where the reference numerals correspond to the reference numerals of FIG. 1.

FIG. 3 is a table showing combinations necessary to display the letters of the Greek alphabet, and more punctuation symbols, where the reference numerals correspond to the reference numerals of FIG. 1.

DETAILED DESCRIPTION OF THE PREFERRED EMBODIMENTS

Figure 1:
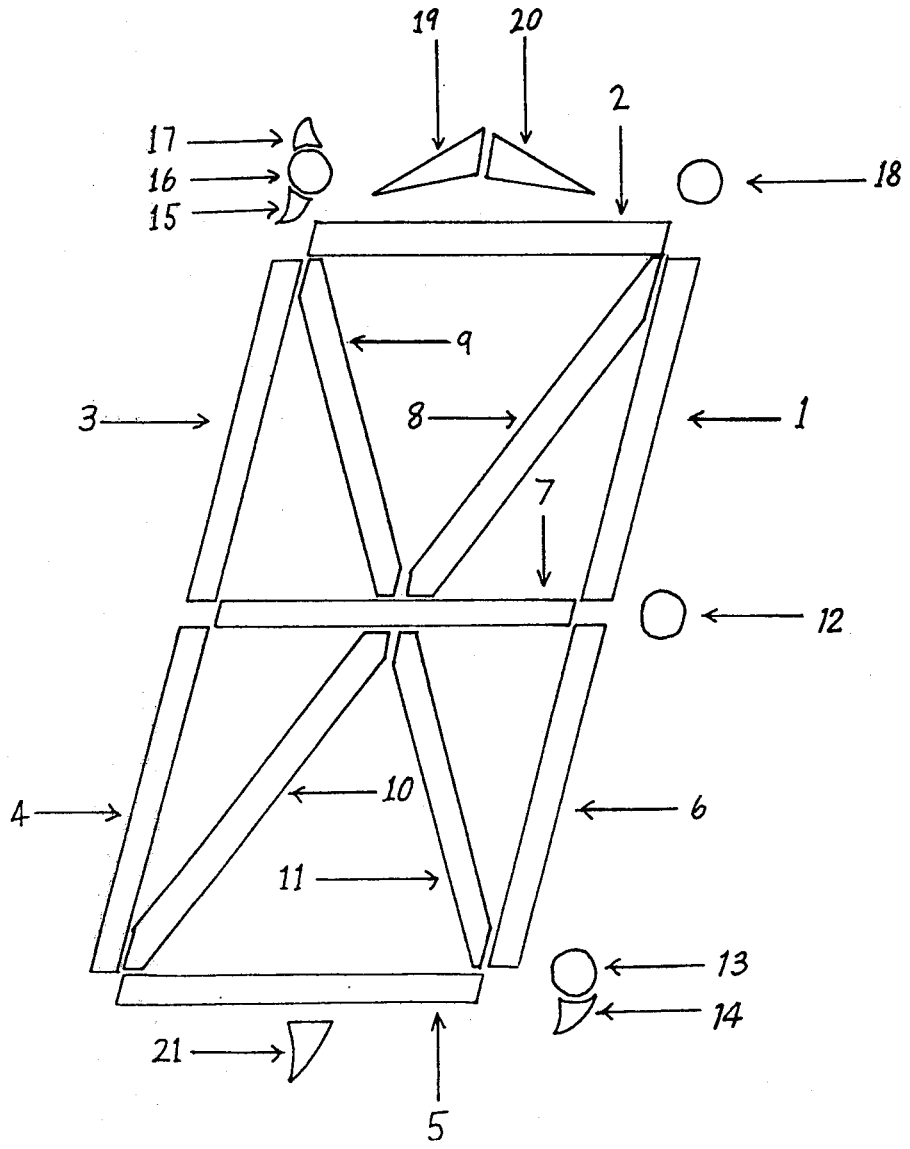
FIG. 1 is a graphical representation of a 'digit' or unit of the display, where the reference numerals correspond to the reference numerals.

Referring now to FIG. 1, the segments numbered from 1 to 7 inclusive are identical to those posessed by a conventional seven segment display, and these segments may be used to display numerals. Segments 8 to 11 inclusive comprise an addition to the seven segment display by the present invention. These four additional segments 8 to 11 permit the display of the present invention to display any letter from both the English and Greek alphabets. It may be appreciated from FIG. 1 that segments 1, 2, 3, 4, 5 and 6 define a substantially upright parallelogram having four corners. Segments 12 to 21 inclusive are used as punctuation symbols. In some uses, absolutely complete punctuation is not always necessary. An example of this is if the display is used as a read out for a laboratory computer. It is suggested that the punctuation section be modified to suit each application, by omitting any unecessary elements.

The tables of FIGS. 2 and 3 show how the segments should be operated to display letters and punctuation symbols. FIG. 2 shows the English alphabet and some punctuation symbols in Column 'A', and the segments (note: the reference numbers refer to the corresponding reference numbers of FIG. 1) which should be operated to display the letter are placed next to the corresponding letter, in Column 'B'. (For example, to make the letter 'C', it is necessary to operate segments 2, 3, 4, and 5.) FIG. 3 is in the same format as is FIG. 2, but illustrates the Greek alphabet as well as some more punctuation. Numbers are displayed here exactly as they would be in a seven segment display, but to avoid confusion between some letters and numbers, '7' should be displayed with Segments 3,2,1, and 6, or 3,2,8, and 10. '0' should be displayed with segments 1,2,3,4,5,6, 8, and 10. In both FIGS. 2 and 3, some letters are shown with two or more combinations of segments to form the letter. In these cases, the suggested combination is listed first. This suggested combination need not be the one used for that particular letter: the purpose, size and even the constructors taste may warrant that another, more suitable combination be used from the list.

The device is operated in the same way as is a seven segment numeric display. The machine coded signal from a source, passes to a decoder/driver circuit. The decoder/driver then, of course, decodes the signal and puts it into such a form that it is able to drive the segments of the display. (For example: a signal for the letter 'C' is decoded and made to drive segments 2, 3, 4, and 5.) The display is usually driven directly by the decoder/driver, thus not requiring circuitry to re-translate the decoded signal to a stage where it can be fed into a CRT display. (Note: the decoder/driver will have to be modified to accept the extra segments, and to decode alphanumeric signals, not just numeric.)

Production of the unit will entail the addition of the extra segments (FIG. 1, segments 8, 9, 10, and 11) and any necessary punctuation elements. The seven segment display is, at present, produced in at least three major forms: the segments being either gas discharge elements, light emitting diodes, or liquid crystal diodes. The design may be adapted to any of these forms quite simply.

As the display is capable of showing any letter from the English and Greek alphabets, it can be used as a 'multi lingual' display in, for example, computers designed to translate one language into another. (Conventional alphanumeric displays usually do not have this feature.) To display words and sentences, the display must be multiplexed. This means that a certain number of units, as illustrated on FIG. 1, are placed side by side. Words and sentences, number sequences, or both, are displayed in the same manner as are multi digit numerals on calculator displays. Furthermore, it is possible to make the entire sentence or sequence of words or digits move from right to left, making the display of sequences, normally exceeding the capacity of the display, possible. When the display is made like this, it is possible for it to display words from languages which have much the same alphabet as does the English language, (such as French, German and the like) the Greek language, or more or less a combination of both (for example, Russian).

When dealing with certain languages, special punctuation is sometimes necessary. Again, it is suggested that only any necessary punctuation elements be used. For example, if the display is to handle English and French, only English and French punctuation should be used.

Finally, the major advantages the invention has over existing systems of displaying alphanumeric characters are: it is generally easier and cheaper to produce than most other alphanumeric displays; it can handle many languages without the need to change the original pattern of segments; it overcomes the problem of size and power consumption of conventional displays; and it is fully solid state in most cases, having the advantages of the form it is constructed in.

What is claimed is:

1. A device for displaying different languages which may include the English and Greek alphabets with punctuation, comprising:

a first parallelogram-shaped array of display segments which may be used to represent letters of said language alphabets;

a second array of display segments located outside of said parallelogram-shaped first array;

said second array including at least a first and a second shaped segment, each of said first and second shaped segments being located at the top of said first parallelogram-shaped array, and shaped and positioned to form a diacritical mark or punctuation mark; and said first and second segments together forming a third mark.

2. The apparatus of claim 1 wherein said second array includes a segment located at the midpoint of the bottom of said first parallelogram-shaped display.

3. The apparatus of claim 1 wherein one of said segments is triangular in shape.

4. The apparatus of claim 3, further including a second triangular-shaped segment located at the approximate midpoint of the top of said first parallelogram-shaped display.

5. The apparatus of claim 1 wherein said second array includes a circular dot-shaped segment located at the midpoint of the right-hand side of said first parallelogram-shaped display.

6. The apparatus of claim 1 wherein said second display includes a circular dot-shaped segment located in the upper right-hand corner of said first parallelogram-shaped display.

7. The apparatus of claim 1 wherein said second display includes a circular dot-shaped segment located in the upper left-hand corner of said first parallelogram-shaped display.

8. The apparatus of claim 1 wherein said second array includes a circular-dot-shaped and triangle-shaped segments, both located in the upper left-hand corner of said first parallelogram-shaped display.

9. The apparatus of claim 1 wherein said second array includes two circular-dot-shaped segments and at least a single triangular-shaped segment located in the upper left-hand corner of said first parallelogram-shaped display.

10. The apparatus as described in claims 1, 2, 3, 4, 5, 6, 7, 8, or 9 wherein said first display consists of eleven segments.

* * * * *